US006412536B1

(12) United States Patent
Vannetta

(10) Patent No.: US 6,412,536 B1
(45) Date of Patent: Jul. 2, 2002

(54) WINDOW AWNING SYSTEM

(75) Inventor: Michael Vannetta, Tampa, FL (US)

(73) Assignee: LAD Diversified Holdings, L.L.C., Tampa, FL (US)

( * ) Notice: Subject to any disclaimer, the term of this patent is extended or adjusted under 35 U.S.C. 154(b) by 0 days.

(21) Appl. No.: 09/902,679

(22) Filed: Jul. 12, 2001

(51) Int. Cl.[7] ..... E04F 10/02

(52) U.S. Cl. ..... 160/57; 160/76; 160/83.1; 160/390; 52/74; 135/117

(58) Field of Search ..... 160/57, 76, 45, 160/47, 50, 56, 83.1, 354, 387, 390; 52/74, 63; 135/117, 121

(56) References Cited

U.S. PATENT DOCUMENTS

| | | | | |
|---|---|---|---|---|
| 419,580 | A | * | 1/1890 | Allen |
| 703,245 | A | * | 6/1902 | Faulkner |
| 713,299 | A | * | 11/1902 | Graf |
| 1,576,886 | A | * | 3/1926 | Williams |
| 1,646,910 | A | * | 10/1927 | Greenspoon |
| 1,932,945 | A | * | 10/1933 | Wilson |
| 3,546,721 | A | * | 12/1970 | Cleary |
| 4,084,358 | A | * | 4/1978 | Winters |
| 4,096,669 | A | * | 6/1978 | Pabst |
| 4,665,671 | A | * | 5/1987 | Sarvis |
| 4,768,317 | A | * | 9/1988 | Markham |
| 4,875,549 | A | * | 10/1989 | Denny et al. |
| 4,888,921 | A | * | 12/1989 | Markham |
| 5,573,026 | A | * | 11/1996 | Griffith |
| 5,966,877 | A | * | 10/1999 | Hawes |

FOREIGN PATENT DOCUMENTS

| | | | |
|---|---|---|---|
| DE | 141790 | * | 11/1901 |
| FR | 2653393 | * | 4/1991 |
| FR | 2694776 | * | 2/1994 |

* cited by examiner

*Primary Examiner*—Blair M. Johnson

(57) ABSTRACT

A window awning system comprises an awning fabric defining an upper edge with a hollow hem formed therein and a lower edge with grommets. An extrusion mounts on the wall. Apertures in a face portion receive wall fasteners and an outwardly extending C-shaped channel. A hem rope is contained within the hem. The hem and rope are then fed into the C-shaped channel. A pair of hollow wall posts have an inboard wall mounting end and an outboard free end. The inboard end has a flat rectangular plate. Each outboard free end receives an end cap. A perimeter cable has a central section passing through holes in the end caps and attaches to the extrusion by the use of metal wire crimps. A lashing rope passes through each grommet of the awning fabric and encompasses the perimeter cable with each pass for securement of the fabric from below.

6 Claims, 4 Drawing Sheets

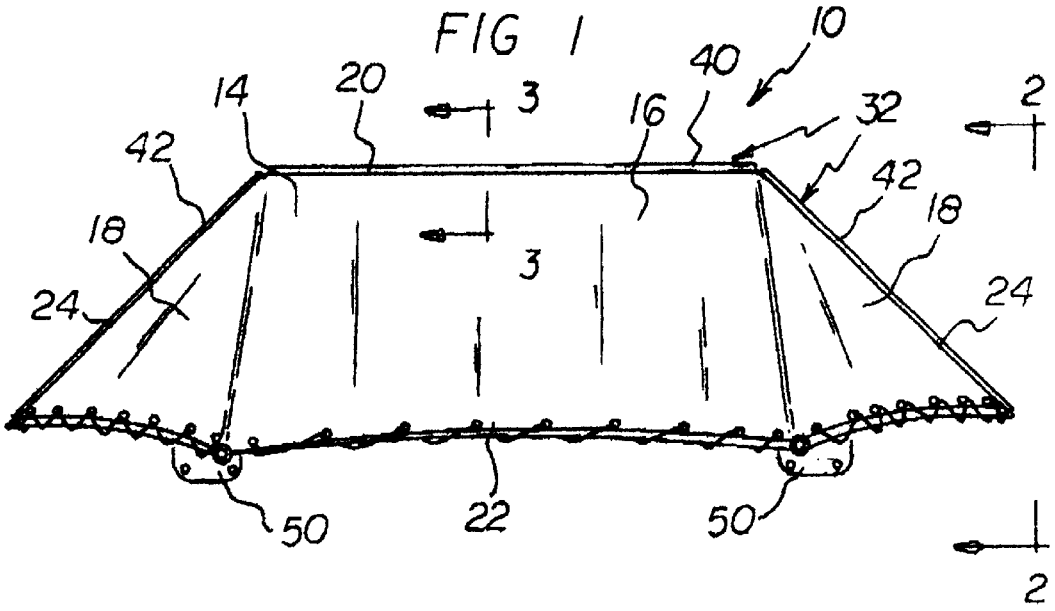
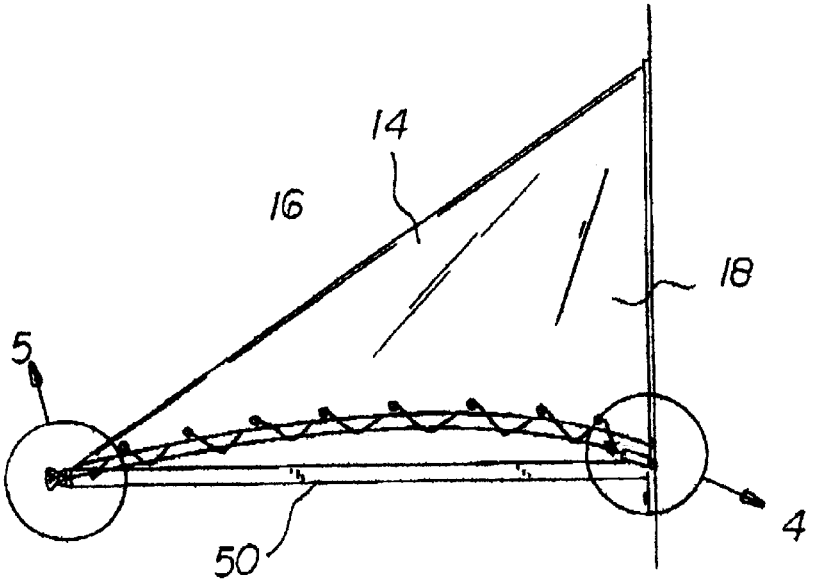
FIG 2

FIG 3
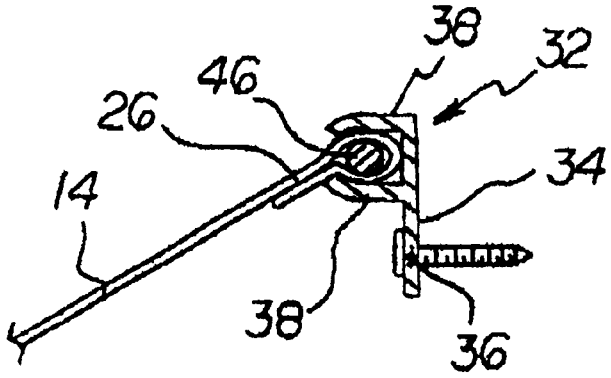
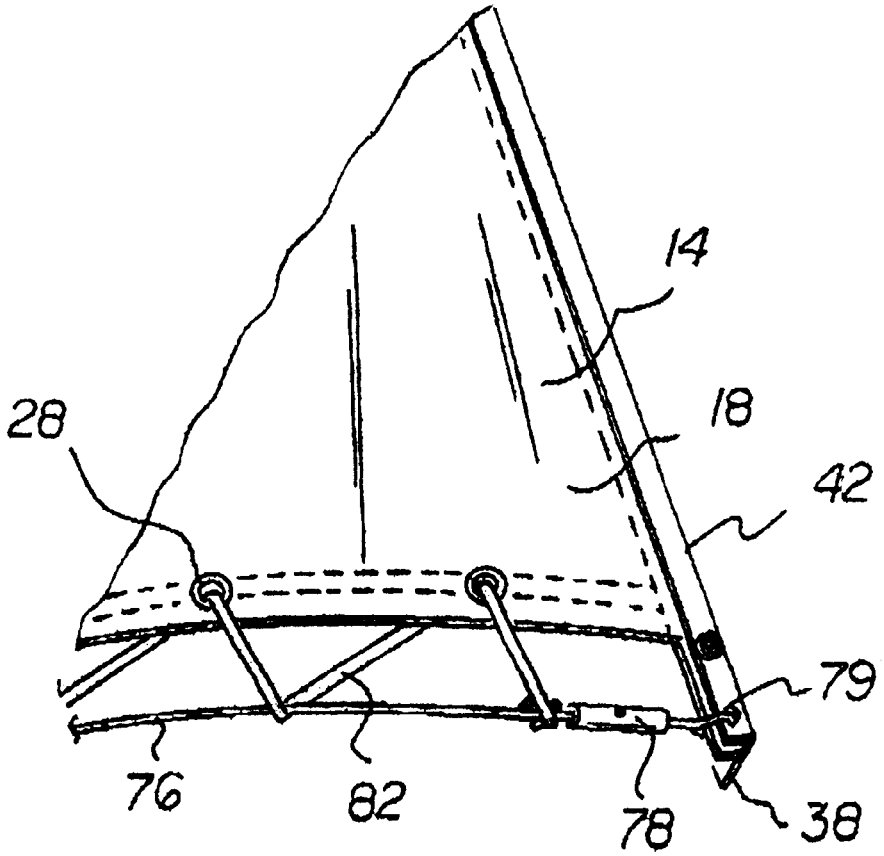
FIG 4

FIG 5
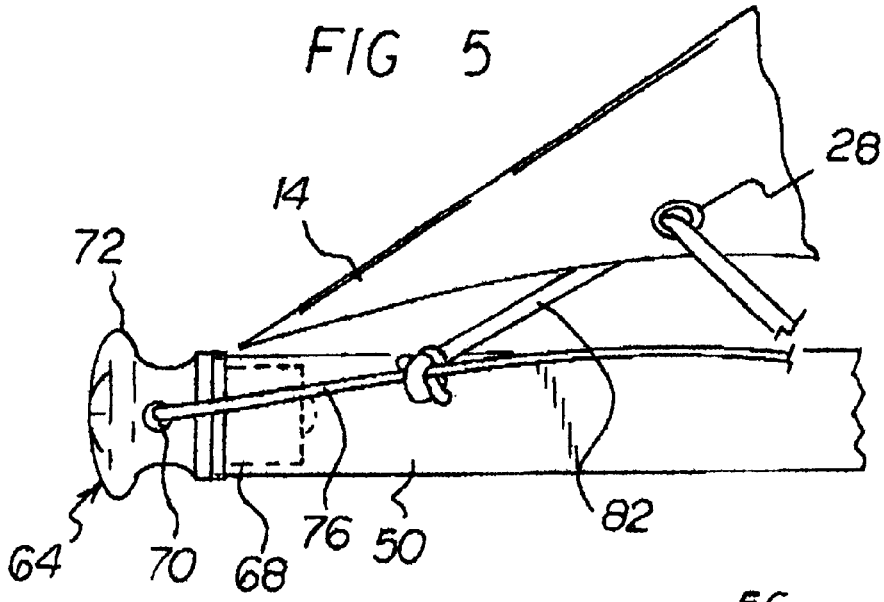
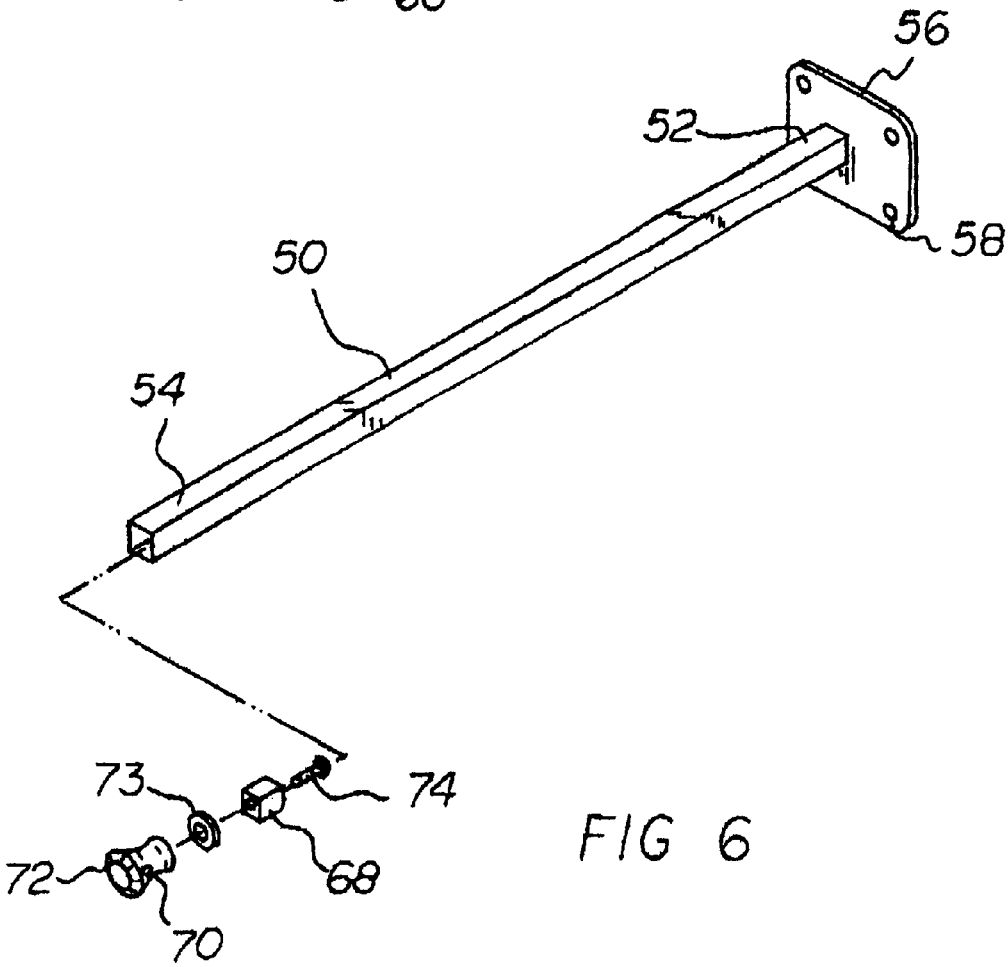
FIG 6

FIG 7
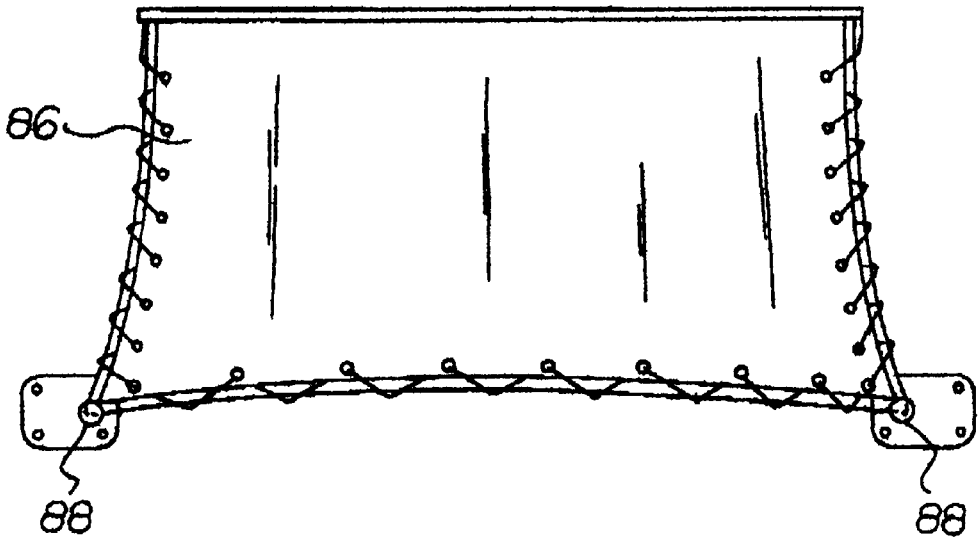
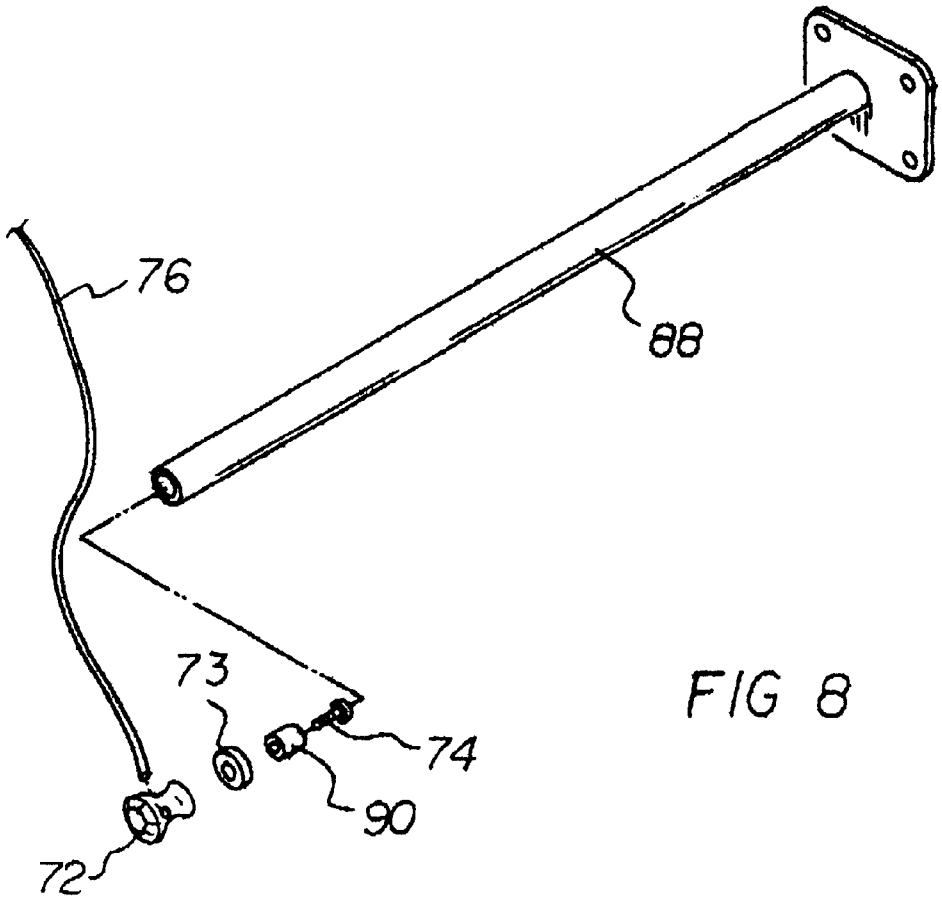
FIG 8

WINDOW AWNING SYSTEM

BACKGROUND OF THE INVENTION

1. Field of the Invention

The present invention relates to a window or door awning system and more particularly pertains to allowing the placement of a window or door awning to a recipient surface such as a wall in a safe and convenient manner.

2. Description of the Prior Art

The use of awnings of known designs and configurations is known in the prior art. More specifically, awnings of known designs and configurations previously devised and utilized for the purpose of supporting awnings by known methods and apparatuses are known to consist basically of familiar, expected, and obvious structural configurations, notwithstanding the myriad of designs encompassed by the crowded prior art which has been developed for the fulfillment of countless objectives and requirements. The primary drawbacks are their extensive metal framework that produce a bulky, heavy awning that is difficult and expensive to ship and install. The amount of welding and materials involved also results in an expensive awning to manufacture.

While these devices fulfill their respective, particular objectives and requirements, the aforementioned patents do not describe a window awning system that allows for shipping and easy installation to a recipient surface, such as a wall, in a safe, convenient and cost effective manner.

In this respect, the window awning system according to the present invention substantially departs from the conventional concepts and designs of the prior art, and in doing so provides an apparatus primarily developed for the purpose of allowing for the ease of shipment of a window awning and simple installation to a recipient surface such as a wall in a safe and convenient manner at a reduced price to the public.

Therefore, it can be appreciated that there exists a continuing need for a new and improved window awning system that is lighter in weight, easier to ship, easier to install and less expensive than the traditional awning.

SUMMARY OF THE INVENTION

In view of the disadvantages inherent in the known types of awnings of known designs and configurations now present in the prior art, the present invention provides an improved window awning system. As such, the general purpose of the present invention, which will be described subsequently in greater detail, is to provide a new and improved window awning system and method which has all the advantages of the prior art and none of the disadvantages.

To attain this, the present invention essentially comprises an awning fabric supported by stainless steel cables and aluminum posts. The awning fabric has a generally trapezoidal configuration. The awning fabric also has a central rectangular area. The awning fabric further has two lateral triangular areas. In this manner a horizontal upper short edge and a horizontal lower long edge are defined. Lateral angled edges are provided between the upper short and lower long edges. The awning fabric is fabricated of a synthetic canvas-like material. A hollow hem is formed in the upper edge and the side edges to encompass a hem rope. A plurality of grommets are inserted along the lower long edge. Provided next is a channel anchor assembly. The channel anchor assembly comprises three extrusions. Each extrusion is of a rigid aluminum material with a rectangular shaped linear face portion. The face portion has apertures for receiving fasteners to allow for the anchoring of the extrusions to a recipient wall surface. Each extrusion also includes an outwardly extending C-shaped receiving channel. The extrusions are comprised of a central horizontal upper extrusion, and two lateral lower extrusions with the ends on the same horizontal plane as the posts described below. The two lateral lower extrusions angle downwardly from the ends of the upper extrusion. In this manner an inverted C-shaped configuration is formed. An aperture is located on each end of the two lateral cover extrusions to accept the stainless steel perimeter cable. A hem rope is provided to secure the fabric to the extrusion. The hem rope is contained within the length of the hem of the awning fabric. The hem rope is inserted into the C-shaped channel for support of the fabric from above. Next provided is a pair of hollow aluminum wall posts. The wall posts are fabricated of a rigid aluminum material with a rectangular or optionally circular configuration. The posts have an inboard wall mounting end and an outboard free end. A span is provided between the inboard wall mounting ends and the outboard free end. The inboard end has a flat rectangular plate. The flat rectangular plate has four mounting apertures. The posts are spaced from each other by a distance essentially equal to the length of the upper extrusion but in no event further apart than 7 feet. The posts have long axes of between 24" and 40". The axes are perpendicular to the plate and a recipient surface. Each outboard end Receives an end cap. The end cap is fabricated of a rigid metallic material having generally solid stepped block. The end cap is either a round or optionally rectilinear configuration, depending on the shape of posts. The inward portion is sized to be received and securely held within the outward end of the posts. A central aperture is provided through the end cap. The outward portion has a generally rectilinear configuration. The outward portion is sized to be larger than the inward portion. The outward portion is further positioned exteriorly of the posts. Further provided is a perimeter stainless steel cable. The perimeter cable has a central section. The central section passes through the end cap apertures. The free ends are attached through the apertures located at the end of the lateral extrusions. The cable is secured by passing each loose end through a wire crimp then through the aperture in the extrusion then back through the crimp which is then pinched with a crimping tool. Lastly provided is a lashing rope. The lashing rope passes in a spiraling manner through each grommet, or eyelet, of the awning fabric. The lashing rope further encompasses the perimeter cable. Each pass provides for the securement of the fabric from below.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window awning system which has all of the advantages of the prior art awnings of known designs and configurations and none of the disadvantages, while allowing for the placement to a recipient surface such as a wall in a safe and convenient manner.

It is another object of the present invention to provide a new and improved window awning system which may be easily and efficiently manufactured, marketed, shipped and installed, resulting in costs savings to the buyer.

It is further an object of the present invention to provide a new and improved window awning system which is light in weight, yet durable and of reliable construction.

The most important aspect of the present invention is to provide a new and improved window awning system which results in a low cost of manufacture with regard to both materials and labor, and which accordingly is then susceptible of low prices of sale to the consuming public, thereby making such window awning system economically available to more of the buying public.

Lastly, it is an object of the present invention to provide a new and improved window awning system comprising an awning fabric. The awning fabric defines upper and lower edges. A hollow hem is formed in the upper edge. Grommets are disposed along the lower edge. An extrusion is provided. The face portion has apertures for receiving fasteners and an outwardly extending C-shaped channel. A hem rope is contained within the hem positioned within the channel. A pair of hollow wall posts are provided. The posts have an inboard wall mounting end and an outboard free end. The inboard end has a flat rectangular plate. Each outboard end has an end cap with an aperture. A perimeter cable is provided. The cable has a central section passing the apertures of the caps. Last provided is a lashing rope. The cable passes in through grommets of the awning fabric and encompasses the perimeter cable with each pass for securement of the fabric from below.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DESCRIPTION OF THE DRAWINGS

FIG. 1 is a front elevational view of the window awning system constructed in accordance with the primary embodiment of the invention.

FIG. 2 is a side elevational view taken along line 2—2 of FIG. 1.

FIG. 3 is a cross sectional view taken along line 3—3 of FIG. 1.

FIG. 4 is an enlarged perspective illustration taken at circle 4 of FIG. 2.

FIG. 5 is an enlarged perspective illustration taken at circle 5 of FIG. 2.

FIG. 6 is an enlarged exploded perspective illustration of one of the posts.

FIG. 7 is front elevational view of the window awning system constructed in accordance with an alternate embodiment of the invention.

FIG. 8 is an enlarged exploded perspective showing of one of the posts from FIG. 7.

DESCRIPTION OF THE PREFERRED EMBODIMENT

The present invention, the window awning 10 is comprised of a plurality of components. Such components in their broadest context include an awning fabric, an extrusion, a hem rope, a pair of hollow wall posts, a perimeter cable, and a lashing rope. Such components are individually configured and correlated with respect to each other so as to attain the desired objective.

First provided is an awning fabric 14. The awning fabric has a generally trapezoidal configuration. The awning fabric also has a central rectangular area 16. The awning fabric further has two lateral triangular areas 18. In this manner a horizontal upper short edge 20 and a horizontal lower long edge 22 are defined. Lateral angled edges 24 are provided between the upper short and lower long edges. The awning fabric is fabricated of a heavy cloth material. A hollow hem 26 is formed in the upper short edge and the side edges. A plurality of eyelets or grommets 28 is disposed along the lower long edge.

Provided next is a channel anchor assembly 32. The channel anchor assembly comprises three extrusions. Each extrusion is of a rigid aluminum material with a rectangular shaped linear face portion 34. The face portion has apertures 36 for receiving fasteners to allow for the anchoring of the extrusions to a recipient surface. Each extrusion also includes an outwardly extending C-shaped receiving channel 38. The extrusions are comprised of a central horizontal upper extrusion 40. The extrusions are also comprised of two lateral lower extrusions 42. The two lateral lower extrusions angle downwardly from the ends of the upper extrusion. In this manner an inverted C-shaped configuration is formed.

A hem rope 46 is provided next. The hem rope is contained within the length of the hem of the awning fabric. The hem rope is further positioned with the hem within the channel for support of the fabric from above.

Next provided is a pair of hollow posts 50. The wall post are fabricated of a rigid metallic material with a rectangular or optionally circular configuration. The posts have an inboard wall mounting end 52 and an outboard free end 54. A span is provided between the inboard wall mounting ends and the outboard free end. The inboard end has a flat rectangular plate 56. The flat rectangular plate has four mounting apertures 58. The posts are spaced on the wall from each other by a distance essentially equal to the length of the upper extrusion. The posts have long axes. The axes are perpendicular to the plate and a recipient surface.

Further provided is an end cap 64. The end cap is fabricated of a rigid metallic material. The end cap is an assembly of an inner portion 68, an outer portion 72 with a hole 70 with an enlarged washer 73 therebetween. Coupling is through a bolt 72 extending through the inward portion and washer and threadedly coupled to the outward portion. The inward portion 68 is sized to be received and securely held within the outward end of the posts. A central aperture 70 is provided through the end cap to receive the cable. The outward portion 72 has a generally ornate configuration. The outward portion and washer are sized to be larger than the inward portion. The outward portion and washer are positioned exteriorly of each post.

Even further provided is a perimeter stainless steel cable 76. The perimeter cable passes through the end cap apertures and the free ends are attached at the ends of the extrusions. The ends are attached to the extrusion by passing through the aperture in the extrusion 79 and secured by metal wire crimps 78.

Last provided is a lashing rope 82. The lashing rope passes in a spiraling manner through each grommet of the awning fabric. The lashing rope further encompasses the perimeter cable. Each pass provides for the securement of the fabric from below.

In another alternate embodiment of the present invention, the fabric is in a rectangular configuration 86 with one extrusion above. In such alternate embodiment, the posts 88 are of a circular cross section. It should be understood, however, that any fabric shape could be used with any post cross section. For example, the round cross sectional posts of the alternate embodiment could be used with the trapezoidal fabric of the primary embodiment while the rectangular cross sectional posts of the primary embodiment could be used with the trapezoidal fabric of the alternate embodiment. The inward portion 90 Of the end cap is of a circular cross section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window awning system for allowing the placement of a window awning to a recipient surface such as a wall in a safe and convenient manner comprising, in combination:

an awning fabric having a generally trapezoidal configuration with a central rectangular area and two lateral triangular areas thereby defining a horizontal upper short edge and a horizontal lower long edge with lateral angled edges there between, the awning fabric being fabricated of a heavy synthetic canvas material, a hollow hem formed in the upper short edge and the side edges, and with a plurality of grommets disposed along the lower long edge;

a channel anchor assembly comprising three extrusions, each extrusion being of a rigid metallic aluminum material with a rectangular shaped linear face portion with apertures for receiving fasteners to allow for the anchoring of the extrusions to a recipient surface, each extrusion also including an outwardly extending C-shaped receiving channel, the extrusions being comprised of a central horizontal upper extrusion and two lateral lower extrusions angling downwardly from the ends of the upper extrusion to form an inverted C-shaped configuration;

a hem rope contained within the length of the hem of the awning fabric and positioned with the hem within the channel for support of the fabric from above;

a pair of hollow aluminum wall posts fabricated of a rigid metallic material having an inboard wall mounting plate and an outboard free end and a span there between with the inboard end having a flat rectangular plate with a plurality of mounting apertures there through, the posts spaced from each other by a distance essentially equal to the length of the upper extrusion and having long axes perpendicular to the plate and a recipient surface, each outboard end having an end cap;

an end cap fabricated of a rigid metallic material having generally solid stepped block with an inward portion sized to be received and securely held within the outward end of the posts with a central aperture there through an outward portion having a generally circular configuration sized to be larger than the inward portion and positioned exteriorly of the posts;

a perimeter cable with a central section passing through the end cap apertures, free ends attached at locations at ends of the aluminum extrusions with crimps coupled to the cable adjacent to at least one end of the cable for tightening purposes; and a lashing rope passing in a spiraling manner through each grommet of the awning fabric and encompasses the perimeter cable with each pass for securement of the fabric from below.

2. A window awning system comprising:

an awning fabric defining an upper edge and a lower edge with a hollow hem formed in the upper edge and with a plurality of grommets disposed along the lower edge;

at least one extrusion with a rectangular shaped linear face portion with apertures for receiving fasteners and an outwardly extending C-shaped channel;

a hem rope contained within the hem of the awning fabric located in the channel;

a pair of hollow wall posts having an inboard wall mounting end and an outboard free end with the inboard end having a flat rectangular plate with axes perpendicular to the plate, each outboard end receiving an end cap with a predrilled hole to accept cable;

a perimeter cable with a central section passing through the holes in the end caps and with free ends attached to ends of the at least one extrusion; and a lashing rope passing in a spiraling manner through each grommet of the awning fabric and encompassing the perimeter cable with each pass for securement of the fabric from below.

3. The system as set forth in claim 2 wherein the posts are of a rectangular cross section.

4. The system as set forth in claim 2 wherein the posts are of a circular cross section.

5. The system as set forth in claim 2 wherein the fabric is in a trapezoidal configuration with three extrusions above.

6. The system as set forth in claim 2 wherein the fabric is in a rectangular configuration with one extrusion above.

* * * * *